United States Patent [19]

Richards

[11] Patent Number: 4,611,855

[45] **Date of Patent: * Sep. 16, 1986**

[54] MULTIPLE LEVEL METHANE DRAINAGE METHOD

[75] Inventor: Walter L. Richards, Huntington Beach, Calif.

[73] Assignee: Methane Drainage Ventures, Placentia, Calif.

[ * ] Notice: The portion of the term of this patent subsequent to Aug. 6, 2002 has been disclaimed.

[21] Appl. No.: 609,473

[22] Filed: May 11, 1984

Related U.S. Application Data

[63] Continuation-in-part of Ser. No. 420,149, Sep. 20, 1982, Pat. No. 4,452,489.

[51] Int. Cl.[4] ..... E21C 41/10; E21B 43/30

[52] U.S. Cl. ..... 299/2; 299/12; 299/19; 166/50

[58] Field of Search ..... 299/2, 12, 19, 10; 166/50; 175/61

[56] References Cited

U.S. PATENT DOCUMENTS

| | | | |
|---|---|---|---|
| 1,660,187 | 2/1928 | Ehrat | 299/2 |
| 2,508,949 | 5/1950 | Howard | 299/2 |
| 3,582,138 | 6/1971 | Loofbourow | 299/19 X |
| 3,823,787 | 7/1974 | Haworth et al. | 175/61 X |
| 4,213,653 | 7/1980 | Grenia | 299/19 X |
| 4,303,274 | 12/1981 | Thakur | 299/12 |
| 4,386,665 | 6/1983 | Dellinger | 175/61 |
| 4,397,360 | 8/1983 | Schmidt | 175/61 |
| 4,502,733 | 3/1985 | Grubb | 299/2 |
| 4,533,182 | 8/1985 | Richards | 299/18 |

*Primary Examiner*—Stephen J. Novosad
*Assistant Examiner*—Michael A. Goodwin
*Attorney, Agent, or Firm*—Walter A. Hackler

[57] ABSTRACT

A method for collecting methane gas from subterranean formations having a plurality of spaced-apart coal seams containing methane gas includes the steps of drilling a shaft from the earth's surface to a depth sufficient to intersect a plurality of seams containing gas to be collected, excavating a cruciform shaped working area at the selected seams with each of the cruciform shaped working areas communicating with the shaft, and drilling a plurality of boreholes from each of the working areas into the seams and collecting methane gas from the boreholes.

18 Claims, 5 Drawing Figures

FIG. 4.
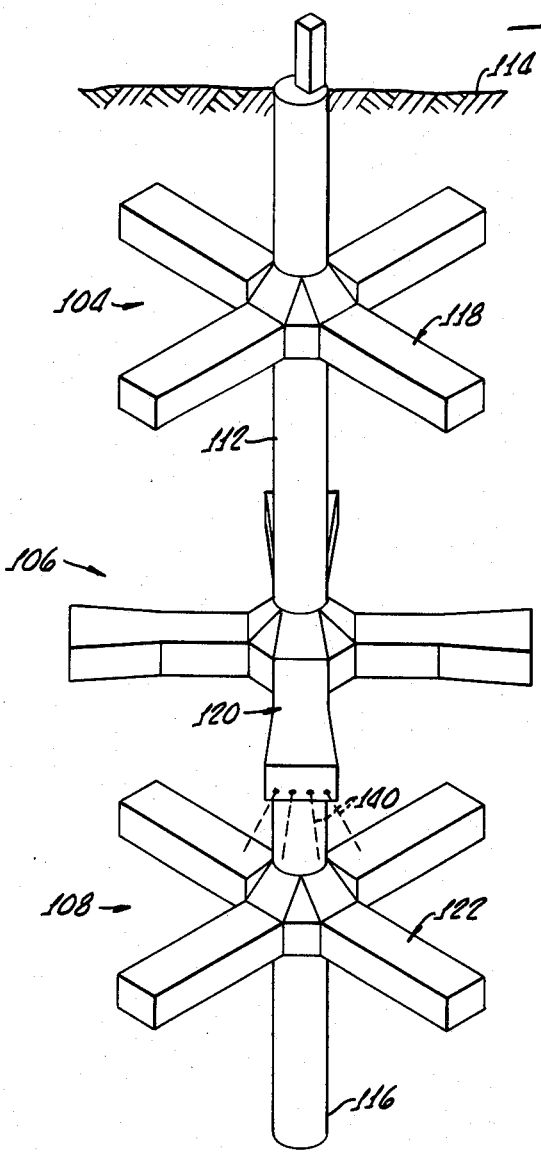
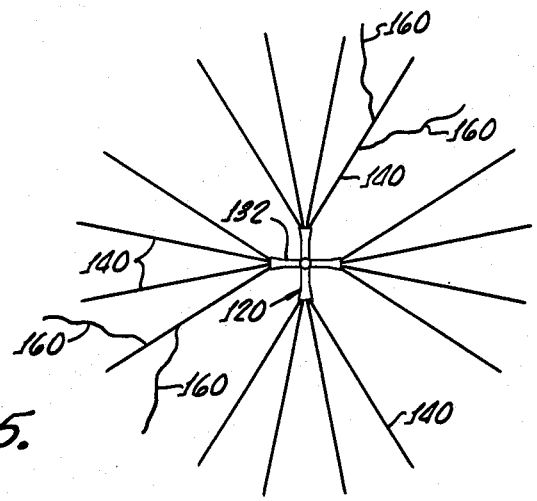
FIG. 5.

MULTIPLE LEVEL METHANE DRAINAGE METHOD

This is a continuation in part of U.S. patent application, Ser. No. 420,149, filed Sept. 20, 1982, now U.S. Pat. No. 4,452,489.

BACKGROUND

The present invention is generally related to the collection of gas from subterranean formations, and more particularly is directed to a method for collecting gas from subterranean formations having a plurality of spaced apart seams containing the gas.

Many subterranean formations may contain gas. As an example, coal seams, or deposits, generally include a significant amount of methane gas which escapes therefrom as the coal is mined, thereby causing hazardous conditions in underground mining operations. Previous attempts to remove methane from underground coal seams has been primarily directed to removal of such gas in order to provide a safe working environment for the mining of coal.

A number of methods are employed to reduce the methane level in working mines. These methods include air dilution systems to provide sufficient air within the mines to reduce the methane level below 1% to prevent a combustive mixture from forming, drilling of vertical shafts from the earth's surface to intersect the seams in advance of mining, and the drilling of holes within the coal seams in advance of mining either from the earth's surface or from an adjacent coal seam. As an example of these methods see U.S. Pat. No. 3,934,649 to Pasini et. al., entitled "Method For Removal of Methane From Coalbeds" and U.S. Pat. No. 4,303,274 to Thakur entitled "Degasification of Coal Seams".

Heretofore, there has been no system or method for the recovery of methane gas from underground, or subterranean, formations irrespective of later mining of the seams for their coal content. The present invention is directed toward a gas drainage system, such as for methane, for collecting such gas from low pressure reservoirs, such as virgin coal seams, through the use of horizontal boreholes completed from a multiplicity of levels. The method is also suitable for removal of methane gas from coal seams having thicknesses less than that required for commercial mining of coal from the coal seam.

SUMMARY OF THE INVENTION

In accordance with the present invention, a method for collecting gas from subterranean formations having a plurality of spaced apart seams containing said gas, includes the steps of drilling a shaft from the earth's surface to a depth sufficient to intersect a plurality of seams containing gas to be collected, excavating a cruciform shaped working area at selected seams with each said cruciform shaped working area communicating with the shaft, drilling at least one borehole from each of said cruciform shaped working areas into the seams, and collecting gas from said borehole and conducting said gas through said cruciform shaped working areas and through the shaft to the earth's surface.

More particularly, in the method of the present invention, the excavated cruciform shaped working areas may include four arms radially disposed from one another at approximately 90 degree intervals and the shaft communicates with each of the cruciform shaped working areas at an intersection of the arms.

Further, the method of the present invention includes the drilling of generally horizontal boreholes outwardly from ends of the arms of the cruciform shaped working areas.

Importantly, the method of the present invention may be utilized for collecting methane gas from subterranean coal seams having a thickness of less than approximately three feet.

In addition, the cruciform shaped working areas are excavated at a plurality of the seams such that overlying and underlying cruciform shaped working areas have arms disposed at approximately 45 degree rotation angle with one another about the shaft.

BRIEF DESCRIPTION OF THE DRAWINGS

The advantages and features of the present invention will appear from the following description considered in conjunction with the accompanying drawings in which:

FIG. 4 is a perspective view of a methane drainage system similar to FIG. 3 except that the arms of the cruciform shaped working area are excavated such that overlying and underlying cruciform shaped working areas have arms disposed at approximately 45 degree rotation angle with one another about the shaft; and, FIG. 5 is a cross section view of the methane drainage system shown in FIG. 3 further illustrating a plurality of generally horizontal deflected boreholes which may be drilled from ends of the cruciform shaped working areas.

DETAILED DESCRIPTION

Figure 1:
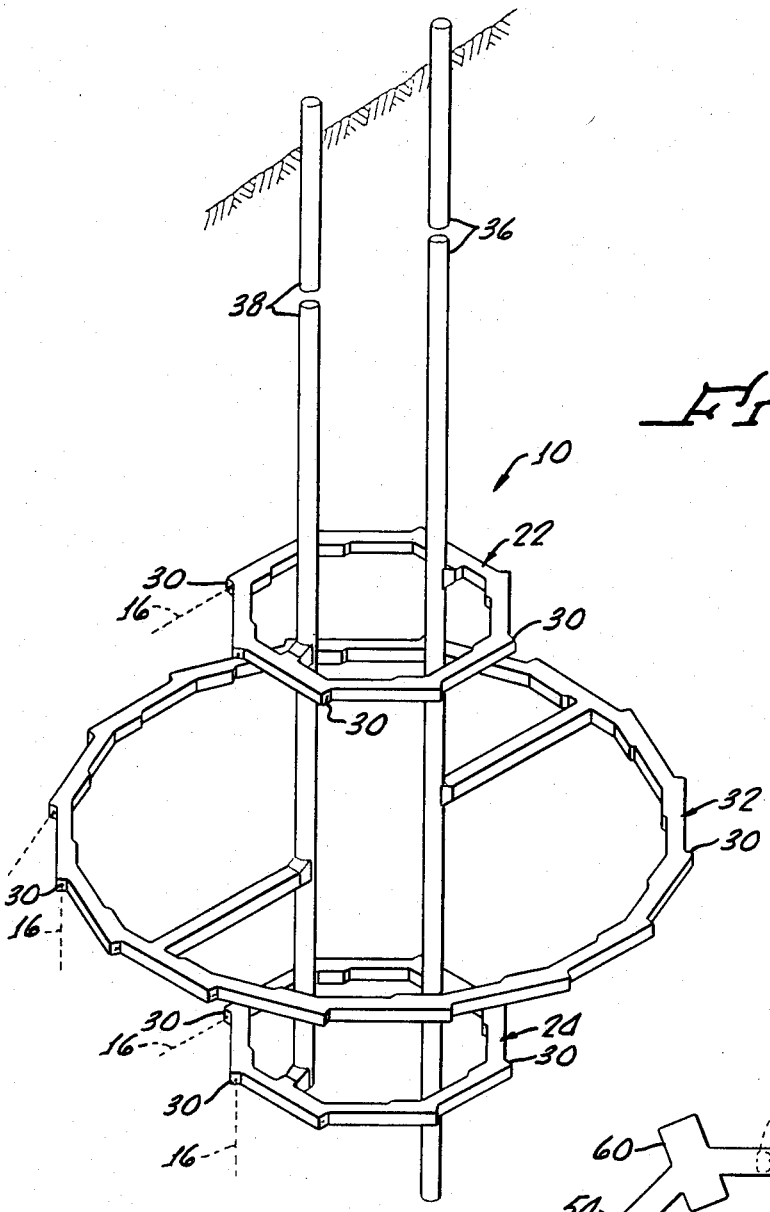
FIG. 1 is a perspective view of a methane drainage system in accordance with the method of the present invention generally showing two shafts drilled from the earth's surface and intersecting three spaced apart coal seams. Also shown are workings at each of the three coal seam levels which include a generally toroidal-shaped working area at each of the coal seam levels and a plurality of boreholes (dashed lines) drilled within the coal seams and outwardly from a toroidal-shaped working area.

Turning now to FIG. 1 there is shown a mining system 10 in accordance with the method of the present invention for removing and collecting methane gas from low pressure reservoirs such as virgin coal seams utilizing a plurality of horizontal boreholes 16 completed from a plurality of spaced apart coal seams.

It has been shown that long horizontal holes are more efficient in draining methane gas from coal seams than vertical holes drilled from the earth's surface. It is to be understood that "horizontal" holes, within the meaning of the present description, means holes that are drilled within the coal seam in a longitudinal manner generally between the top and the bottom of the coal seam as opposed to "vertical" holes which means holes drilled in a fashion to intersect the seams. Hence it can be appreciated that horizontal holes expose more of the coal seam to a conduit system, namely the borehole, for collecting a low pressure methane gas form the coal seam.

In order to access a large amount of methane from underground coal seams, the method of the present invention utilizes the simultaneous draining of methane gas from more than one level, that is from more than one of a plurality of spaced apart subterranean coal seams.

Turning again to FIG. 1 the methane drainage system 10 as shown in completed in three separate levels. It is to be appreciated that any number of levels may be utilized depending upon the number of coal seams present, the thickness of the coal seam, and the amount of methane contained therein as may be determined by sampling techniques. Three levels are shown in FIG. 1 as being typical of a methane drainage system in accordance with the method of the present invention.

As shown in FIG. 1 an upper and a lower level 22, 24 have been constructed to provide for eight well sites, 30, and a middle level 32 is shown for providing sixteen well sites.

This system can utilize a skip shaft 36 which provides for access of personnel, equipment and an intake for fresh air. A return air shaft 38 is provided for the exhaust of return air and also the methane production which is carried in a separate enclosed production pipeline (not shown).

The workings at the upper, middle and lower levels 22, 32, 24 from which the boreholes 16 are drilled may be generally toroidal-shaped in order to provide a good ventilation pattern of fresh air to all the drilling sites. In addition, this arrangement enables a large exposure of coal face area for drilling without the incidence of obstacles.

The shafts 36, 38 as well as the working at the levels 22, 32, 24 are excavated in accordance with well known principles and spaced apart in order to avoid rock mechanics problems. Horizontal boreholes 16 are drilled from each well site 30 in a radial manner and generally horizontally and generally contained in the coal seam at each of the levels being worked. These horizontal boreholes may be drilled in any manner well known in the art and when completed each hole provides a pie-shaped sector of production from a virgin block of coal reservoir for methane gas.

Alternatively, boreholes may be drilled from a working area into overlaying or underlying coal seams without excavating a working area at each coal seam from which gas is to be collected. Factors relating to whether boreholes are drilled in this manner include distance between the seams, the thickness of the seams as well as rock mechanics considerations.

It should be appreciated that the working, or entry chamber system at each level 22, 32, 24 as shown in FIG. 1 are constructed to avoid rock stability problems. The well sites 30, drill chambers, are just wide enough to provide access for drilling and not too wide to produce rock mechanic problems. These well sites may be also located remotely from the shaft to avoid rock mechanics roof support problems adjacent to the shafts.

In order to provide fresh air for drilling, the drilling procedure is to work from the most remote area from the intake shaft 36 back to the intake shaft to thereby enable all drilling to progress in fresh air.

Figure 2:
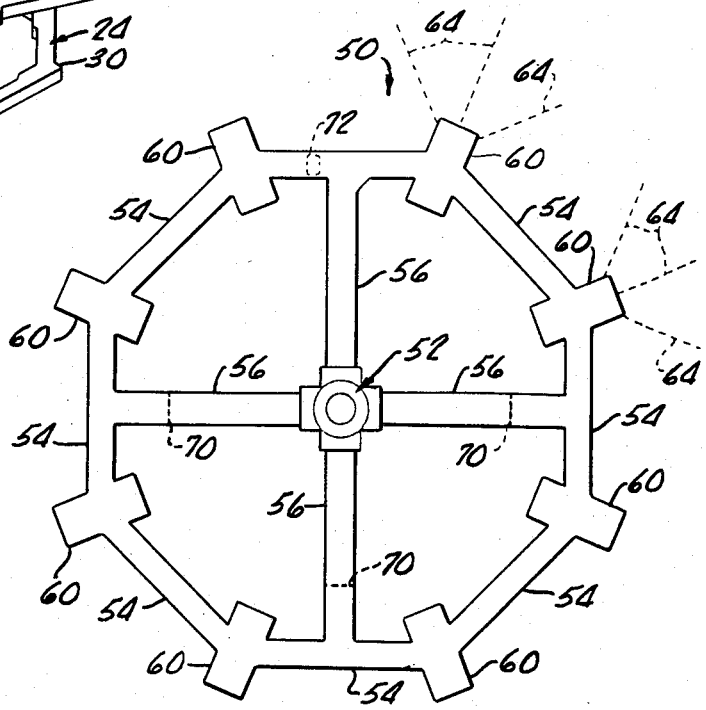
FIG. 2 is a cross sectional view of an alternative working area in one of a plurality of coal seams in accordance with the present invention utilizing a single shaft from the earth's surface and a plurality of drill sites around a toroidal shaped working area for drilling boreholes into the coal seam in generally by radial directions from the toroidal-shaped working area.

An alternate mining system 50 in accordance with the present invention is shown in FIG. 2. This system 50 utilizes a single shaft 52 which intersects a plurality of coal seams (not shown in FIG. 2) and at each level to be worked a generally toroidal-shaped working area 54 is excavated which communicates with the shaft 52 by means of radial quarters 56. Eight drill sites 60 may be provided along the toroidal working area 54 for the drilling of horizontal boreholes 64 therefrom. Airflow is introduced through the shaft 52 and regulated within each of the working areas by air regulators 70 disposed in each of the quarters 56. The exhaust air is removed form the working area by fan 72 communicating with an exhaust duct (not shown) to the earth's surface.

Figure 3:
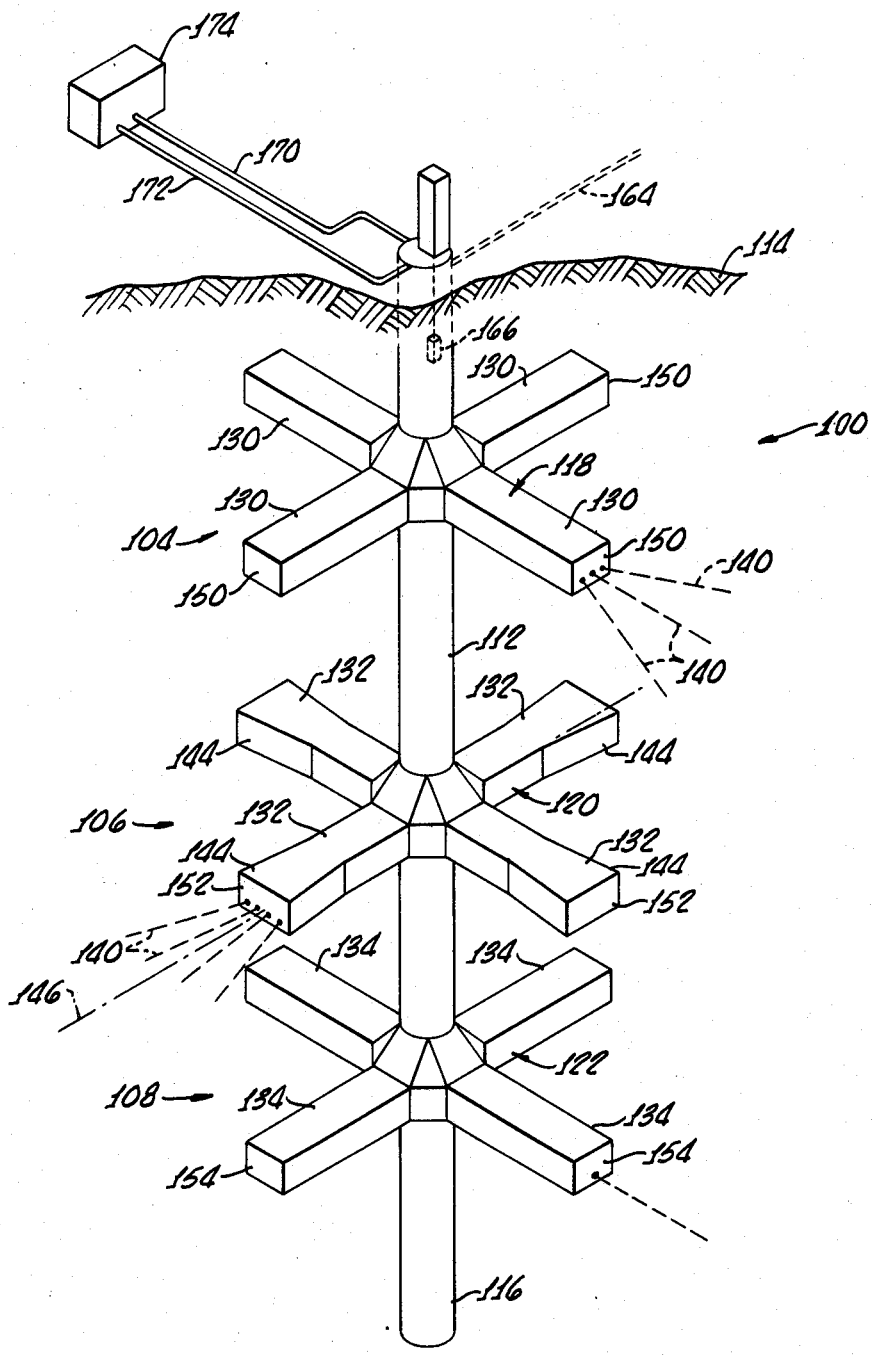
FIG. 3 is a perspective view of an alternative methane drainage system in accordance with the method of the present invention generally showing a single shaft drilled from the earth's surface and intersecting three spaced apart coal seams and having a cruciform gallery design working area at each of the seams.

Turning now to FIGS. 3 and 4, there is shown an alternative mining system 100 in accordance with the method of the present invention for removing and collecting methane gas from low pressure reservoirs.

As shown in FIGS. 3 and 4, the methane drainage system 100 is completed in three separate levels 104, 106, 108. As hereinbefore indicated, any number of levels may be utilized depending upon the number of coal seams present, the thickness of the coal seams, and the amount of methane contained therein as may be determined by standard sampling techniques.

The Figures shown herein are not drawn to any particular scale and do not represent expected spacings between seams and/or the surface of the earth. However, as shown, a shaft 112, which may have a diameter, or dimension if not circular in shape, or approximately 18 feet may be drilled or excavated from the earth's surface 114 to a depth sufficient to intersect a plurality of seams containing gas located at the levels 104, 106, 108. The shaft 112 may be extended below the lowest level 108 to provide a sump portion 116 to conveniently remove water seeping into the excavated shaft 112.

At each of the levels 104, 106, 108, a cruciform shaped working area 118, 120, 122 may be excavated with each of the cruciform areas 118, 120, 122 in communication with the shaft 112. The cruciform shaped working areas 118, 120, 122, each may include any number of arms. Four arms 130, 132, 134, respectively, are shown with each of the arms associated with each cruciform being disposed from one another at approximately 90 degree intervals.

Depending upon the rock mechanics in the mining area, overlying and underlying cruciform shaped working areas 118, 120 may have arms 130, 132 at a preselected rotation angle with one another (such as 45°) about the shaft 112, (compare FIG. 3 with FIG. 4).

The method, in accordance with the present invention (FIG. 4) of excavating cruciform shaped working areas 118, 120, 122 may enable the working of coal seams disposed at levels 104, 106, 108 which are spaced closer together than otherwise would be possible if the arms 130, 132, 134 were aligned with each other, as shown in FIG. 3, because of rock mechanics problems.

Continuing, a plurality of boreholes 140 are drilled in a generally horizontal outwardly direction from each of the arms 130, 132, 134 into the coal seams at levels 104, 106, 108, respectively. A number of drill hole patterns may be employed, such as a three hole pattern shown extending from the arm 130 in level 104 or a four hole pattern shown extending from the arm 132 at level 106.

It should be appreciated that any number of hole patterns may be utilized depending upon the nature and extent of the coal seam into which they extend.

It is expected that each of the arms 130, 132, 134 may extend from approximately 30 feet to approximately 100 feet outwardly from the shaft and have a width of up to about 22 feet.

However, as shown in FIG. 4 at level 106, the arm 132 may have a widened portion 144 to enable either a larger of number of holes to be drilled from the arm 132, or to enable drilling of a borehole at a greater angle from a center line 146 of the arm 132. It is contemplated that most of the boreholes 140 will be drilled from ends 150, 152, 154 because of the size of the equipment (not shown) necessary to drill such boreholes for distances of 4000 feet from the cruciform shaped working areas 118, 120, 122.

A distinct advantage of the system shown in FIGS. 3 and 4 over the system shown in FIGS. 1 and 2 is the amount of excavation necessary to work each coal seam. It is expected that a cruciform working shaped working area will require less than two-thirds of the rock excavation necessary to implement the toroidal-shaped working areas shown in FIGS. 1 and 2.

FIG. 5 is a cross-sectional view of the cruciform shaped working area 120 at level 106 showing a four hole drill pattern extending from ends 152 of the arms 132. As it is apparent from FIG. 5, as the holes 140 extend outwardly from the cruciform shaped working area 120, the spacing between the holes 140 becomes larger and larger.

To enhance the methane gas recovery from these outlying or remote areas, generally horizontal, deflected or deviated holes 160 may be drilled from the primary boreholes 140. It should be appreciated that the term "generally horizontal boreholes" and "generally horizontal deviated boreholes" is intended to mean boreholes which are drilled into the coal seams being worked. As these coal seams generally are horizontal but may move up and down in an undulating pattern, each of the horizontal holes drilled must change in course to remain within the coal seam at all times.

The horizontal boreholes 140, as well as the deviated boreholes 160, may be drilled in any manner well known in the art and typically have diameters of about two to about six inches.

It should also be appreciated that the boreholes 140 may be drilled from a working area 118, 120, 122 into an overlaying or underlaying coal seam (not shown) without excavating a working area at such an overlaying or underlaying coal seam from which the gas is to be collected. Factors relating to whether boreholes are drilled in this manner include distance between the seams, the thickness of the seams, as well as rock mechanic considerations.

The system 100 shown in FIGS. 3, 4 and 5 also are effective for collecting gas from coal seams having a thickness of less than approximately 3 feet. Although the height of the arms 130, 132, 134 may be greater than 3 feet to enable the movement of personnel and equipment therein, the horizontal boreholes 140 and deviated boreholes 160 drilled therefrom, remain within the coal seam and effective for draining methane gas therefrom.

To facilitate the collecting of gas from the boreholes and conducting the gas through the cruciform shaped working areas through the shaft 112 to the earth's surface 114, liners may be inserted in each of the boreholes 140 and/or deviated boreholes 160 which are connected to a conduit system (not shown) within the cruciform shaped working areas 130, 132, 134 and shaft 112 for transferring the methane gas to the earth's surface where it is fed to a production gas pipe 164.

As shown in FIG. 3, a skip 166 may be provided to enable the movement of personnel and equipment to and from the levels 104, 106, 108 of the mining system 100 via the shaft 112 in a conventional manner. Ventilation air is also provided in the conventional manner as depicted by ventilation air conduits 170, 172 which are connected to ventilation fans 174 as is well known in the art.

It is to be appreciated that any number of mining systems may be constructed in accordance with the method of the present invention and, although there has been described hereinabove a number of specific systems and methods for collecting gas from subterranean formations in accordance with the present invention, for the purpose of illustrating the manner in which the invention may be used to advantage, it should be appreciated that the invention is not limited thereto. Accordingly, any and all modifications, variations or equivalent methods which may occur to those skilled in the art should be considered to be within the scope of the invention as defined by the appended claims.

What is claimed is:

1. A method for collecting gas from subterranean formations having a plurality of spaced-apart seams containing said gas, said method comprising the steps of:

drilling a shaft from the earth's surface to a depth sufficient to intersect a plurality of seams containing gas to be collected;

excavating a cruciform-shaped working area at selected seams with each said cruciform-shaped working area communicating with said shaft and said selected seams;

drilling at least one borehole from each of said cruciform-shaped working areas into the seams; and, collecting gas from said borehole and conducting said gas through said cruciform-shaped working areas and through said shaft to the earth's surface.

2. The method of claim 1, wherein each cruciform shaped working area includes four arms radially disposed from one another at approximately 90 degree intervals and the shaft communicates with each of the cruciform shaped working areas at an intersection of the arms.

3. The method of claim 2, wherein the step of drilling at least one borehole from each of said cruciform shaped working areas includes drilling a generally horizontal borehole outwardly from each of the cruciform shaped working areas.

4. The method of claim 3, wherein the step of drilling at least one borehole from each of said cruciform shaped working areas includes the drilling of a generally horizontal borehole outwardly from ends of the arms of the cruciform shaped working areas.

5. A method for collecting gas from subterranean formations having a plurality of spaced-apart seams containing said gas, said method comprising the steps of:

drilling a shaft from the earth's surface to a depth sufficient to intersect a plurality of seams containing gas to be collected;

excavating a cruciform-shaped working area at each seam from which gas is to be collected, each said cruciform-shaped working area communicating with said shaft and said selected seams;

excavating a plurality of drill sites within said cruciform-shaped working area, said drill sites being remote from said shaft;

drilling a plurality of generally horizontal boreholes from each of said drill sites into the seams containing said cruciform-shaped working areas, said generally horizontal boreholes being drilled outwardly from said drill sites in a spaced-apart relationship; and, collecting gas from said boreholes and conducting said gas through said cruciform-shaped working areas and through said shaft to the earth's surface.

6. The method of claim 1, 2, 3, 4, or 5, wherein at least one of the seams from which gas is to be collected has a thickness of less than about three feet.

7. The method of claim 6 further comprising the step of inserting a liner in each of the boreholes and connecting said liners to a conduit system within the cruciform shaped working areas and shaft for transferring said gas to the earth's surface.

8. The method of claim 5 further comprising the step of drilling a plurality of generally horizontal deflected boreholes from at least one of said generally horizontal boreholes, said deflected boreholes originating and remaining within the coal seam for drawing gas therefrom.

9. The method of claim 8, wherein at least one of the seams from which gas is to be collected has a thickness of less than about three feet.

10. A method for collecting gas from subterranean formations having a plurality of spaced apart seams containing said gas, said method comprising the steps of:

drilling a shaft from the earth's surface to a depth sufficient to intersect a plurality of seams containing gas to be collected;

excavating a cruciform shaped working area at selected seams, each cruciform shaped working area including four arms radially disposed from one another at approximately 90 degree intervals, said shaft communicating with each of the cruciform shaped working areas at an intersection of the arms, said cruciform shaped working areas being excavated such that overlying and underlying cruciform shaped working areas have arms disposed at a preselected rotation angle with one another about the shaft;

drilling a plurality of boreholes from each of said cruciform shaped working areas in the seams; and, collecting gas from said boreholes and conducting said gas through said cruciform shaped working areas and through said shaft to the earth's surface.

11. The method of claim 10, wherein the step of drilling a plurality of boreholes from each of said cruciform shaped working areas includes drilling generally horizontal boreholes outwardly from each of the cruciform shaped working areas.

12. The method of claim 11, wherein the step of drilling a plurality of boreholes from each of said cruciform shaped working areas includes the drilling of generally horizontal boreholes outwardly from ends of the arms of the cruciform shaped working areas.

13. The method of claim 10, 11, or 12, wherein at least one of the seams from which gas is to be collected has a thickness of less than about three feet.

14. The method of claim 13 further comprising the step of inserting a liner in each of the boreholes and connecting said liners to a conduct system within the cruciform shaped working areas and shaft for transferring said gas to the earth's surface.

15. A method for collecting gas from subterranean formations having a plurality of spaced-apart seams containing said gas, said method comprising the steps of:

drilling a shaft from the earth's surface to a depth sufficient to intersect a plurality of seams containing gas to be collected;

excavating a cruciform-shaped working area within a plurality of the seams intersected by said shaft, each said cruciform-shaped working area communicating with said shaft and said selected seams;

drilling a plurality of generally horizontal boreholes from each of said cruciform shaped working areas into the seams containing said cruciform shaped working areas, said generally horizontal boreholes being drilled outwardly from said working areas in a spaced-apart relationship; and, collecting gas from said boreholes and conducting said gas through said cruciform-shaped working areas and through said shaft to the earth's surface.

16. A method for collecting methane gas from subterranean formations having a plurality of spaced apart coal seams containing said methane gas, said coal seams having a thickness of less than three feet, said method comprising the steps of:

drilling a shaft from the earth's surface to a depth sufficient to intersect a plurality of coal seems containing methane gas to be collected;

excavating a cruciform shaped working area at each coal seam from which methane gas is to be collected, each said cruciform shaped working area communicating with said shaft;

drilling a plurality of generally horizontal boreholes from each of said cruciform shaped working areas into the coal seams containing said cruciform shaped working areas, said generally horizontal boreholes being drilled outwardly from said cruciform shaped working areas in a spaced apart relationship; and, collecting methane gas from said boreholes and conducting said methane gas through said cruciform shaped working areas and through said shaft to the earth's surface.

17. A method for collecting methane gas from subterranean formations having a plurality of spaced apart coal seams containing said methane gas, said method comprising the steps of:

drilling a shaft from the earth's surface to a depth sufficient to intersect a plurality of coal seems containing methane gas to be collected;

excavating a cruciform shaped working area at selected coal seams, each cruciform shaped working area including four arms radially disposed from one another at approximately 90 degree intervals, said shaft communicating with each of the cruciform shaped working areas at an intersection of the arms, said cruciform shaped working areas being excavated such that overlying and underlying cruciform working areas have arms disposed at an approximately 45 degree rotation angle with one another about the shaft;

drilling a plurality of generally horizontal boreholes from each of said cruciform shaped working areas in the coal seams;

drilling at least one generally horizontal deflected boreholes from at least one of said generally horizontal borehole; and, collecting methane gas from said boreholes and conducting said gas through said cruciform shaped working areas and through said shaft to the earth's surface.

18. The method of claim 17, wherein at least one of the seams from which gas is to be collected has a thickness of less than about three feet.

* * * * *